US007259641B1

(12) United States Patent
Weller et al.

(10) Patent No.: US 7,259,641 B1
(45) Date of Patent: Aug. 21, 2007

(54) MICROELECTROMECHANICAL SLOW-WAVE PHASE SHIFTER DEVICE AND METHOD

(75) Inventors: Thomas Weller, Lutz, FL (US); Balaji Lakshminarayanan, Tampa, FL (US)

(73) Assignee: University of South Florida, Tampa, FL (US)

( * ) Notice: Subject to any disclaimer, the term of this patent is extended or adjusted under 35 U.S.C. 154(b) by 0 days.

(21) Appl. No.: 10/906,626

(22) Filed: Feb. 28, 2005

Related U.S. Application Data

(60) Provisional application No. 60/521,146, filed on Feb. 27, 2004.

(51) Int. Cl.
*H01P 1/18* (2006.01)

(52) U.S. Cl. ..... 333/161; 333/156

(58) Field of Classification Search ..... 333/161, 333/162, 163, 156
See application file for complete search history.

(56) References Cited

U.S. PATENT DOCUMENTS 5,369,381 A * 11/1994 Gamand ..... 333/161
6,133,807 A * 10/2000 Akiyama et al. ..... 333/101
6,559,737 B1 * 5/2003 Nagra et al. ..... 333/156
2003/0146806 A1 * 8/2003 Nuecther et al. ..... 333/161

* cited by examiner

*Primary Examiner*—Benny T. Lee
(74) *Attorney, Agent, or Firm*—Molly L. Sauter; Smith & Hopen, P.A.

(57) ABSTRACT

The present invention provides a method and apparatus for a monolithic device utilizing cascaded, switchable slow-wave CPW sections that are integrated along the length of a planar transmission line. The purpose of the switchable slow-wave CPW sections elements is to enable control of the propagation constant along the transmission line while maintaining a quasi-constant characteristic impedance. The device can be used to produce true time delay phase shifting components in which large amounts of time delay can be achieved without significant variation in the effective characteristic impedance of the transmission line, and thus also the input/output return loss of the component. Additionally, for a particular value of return loss, greater time delay per unit length can be achieved in comparison to tunable capacitance-only delay components.

22 Claims, 14 Drawing Sheets

Fig. 8

125 120

| | Shunt Beam (μm) | Ground Plane Beam(μm) |
|---|---|---|
| Width | 40 | 70 |
| Length | 440 | 285 |
| Actuation Voltage | 30V | 45V |

135 140 145

130

MICROELECTROMECHANICAL SLOW-WAVE PHASE SHIFTER DEVICE AND METHOD

CROSS-REFERENCE TO RELATED DISCLOSURE

This application claims priority to provisional application entitled: "True Time Delay Phase Shifting Method and Apparatus with Slow-Wave Elements," filed Feb. 27, 2004 by the present inventors and bearing application No. 60/521,146.

GOVERNMENT SUPPORT

This invention was developed under support from the National Science Foundation under grant/contract number 2106-301-LO; accordingly the U.S. government has certain rights in the invention.

BACKGROUND OF INVENTION

A true time delay (TTD) phase shifter is a component used in microwave and millimeter wave radar and communications systems to control the time delay imposed upon a signal along a particular signal path within a system. The most common use of TTD components is within phased array radars, where it is possible that thousands of TTD components may be necessary and would be connected to each antenna element within a large array of such elements. In such an example the TTD components would facilitate electronic steering of the transmit and/or receive direction of the antenna array. The most common implementation of TTD components using current technology is in the form of a monolithic microwave integrated circuit (MMIC), in which transistors are used to realize switches, and these switches are used to select among different sections of transmission lines of varying length, thus enabling a tuning of the time delay. In the past 3-4 years new implementations of TDD components have been developed based upon the use of radio frequency micro electro mechanical systems (RF MEMS).

Distributed micro electromechanical (MEM) transmission lines (DMTLs) are a proven solution for very high performance, low loss true time delay phase shifters. The DMTL, as known in the art, usually consists of a uniform length of high impedance coplanar waveguide (CPW) that is loaded by periodic placement of discrete MEM capacitors. The MEM devices are typically designed such that the reflection coefficient for the input, S11, for a DMTL section is less that −10 dB for the two phase states, i.e. MEM capacitors in the up- and down-state positions. The increase in the distributed capacitance in the down-state provides a differential phase shift ($\Delta\phi$) with respect to the phase in the upstate.

A limitation of the capacitively-loaded DMTL known in the prior art is that the amount of phase shift is proportional to the difference in the loaded and unloaded impedances, thus restricting the achievable $\Delta\phi$ per unit length in light of impedance matching considerations.

Today, a large phased array radar system can cost millions of dollars. This cost can be lowered by orders of magnitude through the use of MEMS technologies. Still, there is a physical limitation to the performance achievable with RF MEMS TTD devices that operate only on the change of the capacitive loading of a transmission line. As the capacitance changes, a property of the transmission line known as the characteristic impedance (Zo) changes along with the desired change in the propagation constant. As Zo changes, there is a mismatch that arises between the TTD device and the system in which it is integrated, causing power to be reflected from the TTD device input. This mismatch is often described in terms of a parameter known as return loss (RL). A generally accepted upper limit for RL is 10 dB. The physical limitation of the capacitive only TTD device is that the amount of time delay per unit length of transmission line that can be achieved is restricted by the need to keep RL>10 dB. As one attempts to achieve greater time delay, larger changes in Zo are inherently produced, thereby decreasing the RL.

What is needed in the art is a device that improves upon the capacitance-only TTD device architecture currently known in the art. Accordingly, a device that produces true time delay phase shifting in which large amounts of time delay can be achieved without significant variation in the effective characteristic impedance of the transmission line, and thus also the input/output return loss of the component, would solve the problem of the devices currently known in the art for use in the microwave and mm-wave industry.

SUMMARY OF THE INVENTION

The present invention provides a method and apparatus for RF MEMS TTD components in which RF MEMS tunable components are placed along the length of a transmission line. As the mechanical configuration of the MEMS devices is changed, through electro static actuation, the effective loading on the transmission line is changed, which in turn changes the propagation constant and the corresponding time to propagate along the transmission line.

In accordance with the present invention, a microelectromechanical slow-wave phase shifter device and method of use are provided including at least one center conductive element, at least two ground plane elements laterally located proximal to the center conductive element, the at least two ground plane elements having a slot formed within, at least one actuatable ground shorting beam and an actuatable shunt beam configured to control access to the slot formed in the at least two ground plane elements.

The actuatable ground shorting beam further includes a first two actuatable ground shorting beams having electrical connectivity to a first of the two laterally located ground plane elements, and a second two actuatable ground shorting beams having electrical connectivity to a second of the two laterally located ground plane elements and a ground shorting beam bias line to control actuation of the ground shorting beams. In a particular embodiment, the slot formed in the ground plane has entrance point and an exit point to the transmission line. As such, a first of the two actuatable ground shorting beams controls access to the entrance point and a second of the two actuatable ground shorting beams controls access to the exit point of the slot.

The actuatable shunt beam is suspended over the center conductive element and electrically connects the two ground plane elements. A shunt beam bias line is used to control actuation of the shunt beam.

In a particular embodiment, the actuation of the shunt beam and the ground shorting beams are controlled by an electrostatic force supplied through the appropriate bias line.

The slow-wave device of the present invention can be pre-fabricated and then integrated with a planar transmission line having a center conductor and two laterally located ground planes on either side of the center conductor. In this configuration, the center conductive element is electrically connected to the center conductor of the planar transmission line and each of the two ground plane elements are electrically connected to each of the two laterally located ground planes of the transmission line.

In an additional embodiment, a plurality of conductive slots may be formed to provide additional propagation delay and the ability to have a multi-bit system. With this configuration, at least two ground plane elements are laterally located proximal to the center conductive element, and the at least two ground plane elements include a plurality of conductive slots formed within and electrically isolated from each other. As such, a plurality of actuatable ground shorting beams and a plurality of actuatable shunt beams are configured to control access to the slots formed in the at least two ground plane elements. The plurality of actuatable ground shorting beams and the plurality of actuatable shunt beams may be addressed either individually or simultaneously. This configuration allows for a multi-bit phase shifter.

In a particular embodiment, the actuation of the plurality of actuatable ground shorting beams and the plurality of actuatable shunt beams is such that a multi-bit phase shifter for use as a tunable thru-reflect-line calibration set is provided.

In comparison to the MMIC devices currently known in the art, the RF MEMS TTD components in accordance with the present invention provide better performance (lower loss) and significantly lower cost. The present invention improves upon the capacitance-only TTD device architecture by introducing cascaded, switchable slow-save CPW sections. Theoretically, the time delay can be increased to any value while maintaining a fixed value for Zo. As such, dramatic improvements upon the current state of the art (SOTA) have been demonstrated.

The present invention enables the production of a new class of TTD devices that offer higher performance, smaller size and lower cost. In accordance with the present invention a new true time delay MEM phase shifter topology is presented that overcomes the limitations of the capacitor-only DMTL. The topology uses cascaded, switchable slow-wave CPW sections to achieve high return loss in both states, a large $\Delta\phi$ per unit length, and phase shift per dB that is comparable to previously reported performance In a particular embodiment, the slow-wave MEM device in accordance with the present invention achieved a greater than 20 dB return loss in both states with the maximum $\Delta\phi$. Experimental results for a single, 460 micron long slow-wave unit-cell demonstrate RL greater than 22 dB through 50 GHz with $\Delta\phi$~410 at 50 GHz. A 4.6 mm-long phase shifter comprised of 10 slow-wave unit-cells provides a measured $\Delta\phi$ per dB of approximately 317°/dB (or 91°/mm) at 50 GHz with RL greater than 21 dB.

In an alternate design, the slow wave structure was also loaded with discrete MEM capacitors. For this design, the measured $\Delta\phi$ per dB is 257°/dB at 50 GHz with RL greater than 19 dB. This topology provides an attractive alternative for increasing the phase shift per dB if the constraint on the return loss is reduced. In a particular embodiment, a reconfiguration MEMS-based transmission line is provided in which there is independent control of the propagation delay and the characteristic impedance. In accordance with this embodiment, separate control of inductive and capacitive MEMS slow-wave devices in accordance with the present invention are used either to maintain a constant LC product (constant $Z_0$) or a constant L/C ratio (constant $\beta$), while changing the ratio or product, respectively. This embodiment employs metal-air-metal capacitors at the input and output of each of the slow-wave sections.

Accordingly, the present invention provides a device and method that improves upon the capacitance-only TTD device architecture currently known in the art. The slow-wave device in accordance with the present invention produces true time delay phase shifting in which large amounts of time delay are achieved without significant variation in the effective characteristic impedance of the transmission line, and thus also the input/output return loss of the component.

BRIEF DESCRIPTION OF THE DRAWINGS

For a fuller understanding of the invention, reference should be made to the following detailed description, taken in connection with the accompanying drawings, in which:

FIG. 8 is a table of exemplary characteristics of the slow-wave unit-cell in accordance with the present invention.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The differential phase shift between the up- and down-states of a DMTL with capacitive-loading is accompanied by a change in the effective characteristic impedance in each state. Using the quasi-TEM assumption, the relationship between phase shift for a DMTL of length L and characteristic impedance is derived as shown below in Equation 1. Assuming a reference impedance of 50Ω, $Z_{up}$ and $Z_{dn}$ need to be approximately 55Ω and 45.4Ω, respectively, in order to maintain RL greater than 20 dB. The resulting Δϕ per unit length is 17.8°/mm at 50 GHz. Achieving this small variation in the impedance requires tight control over the value of the MEM capacitor in the up- and down-state positions.

$$\Delta\phi = \left(\frac{\omega Z_0\sqrt{\varepsilon_{eff}}}{c}\right)\cdot\left(\frac{1}{Z_{up}} - \frac{1}{Z_{dn}}\right)\cdot L \text{ rad} \tag{1}$$

Figure 1:
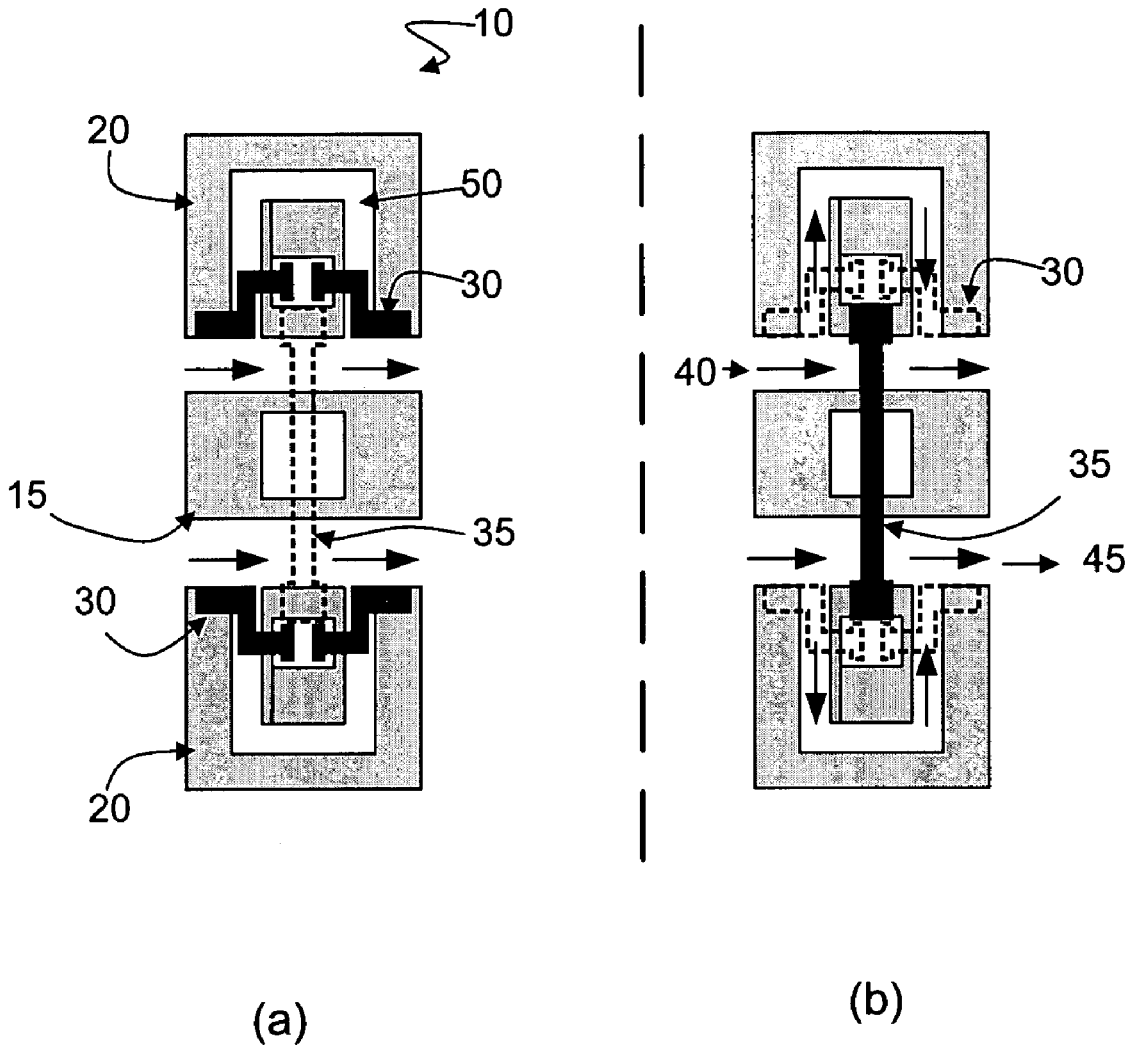
FIG. 1 is an illustrative schematic of the slow wave structure in the Normal and Slow-wave states in accordance with the present invention.
Figure 2:
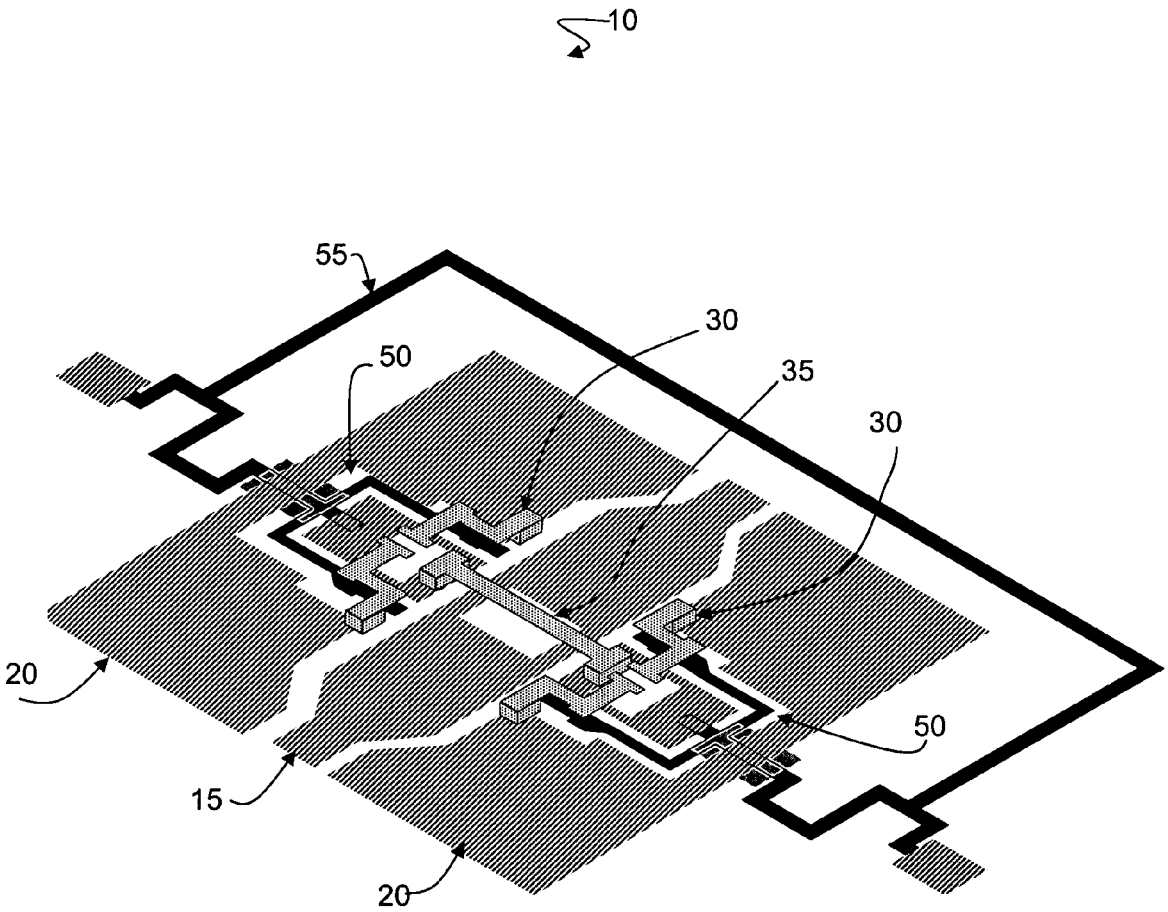
FIG. 2 is an illustrative 3-dimensional view of the slow-wave unit cell in accordance with the present invention.

The MEM slow-wave unit-cell 10 shown in FIG. 1 is designed to provide small variations in the impedances around 50Ω, with a Δϕ per unit length that is comparable to (and greater than) a capacitively-loaded DMTL that has a worst-case RL near 10 dB. In an exemplary embodiment, the unit-cell is 460 μm long and consists of two beams 30 on each ground plane 20 and a shunt beam 35 that connects the ground planes 20 and is suspended over the center conductor 15. In the normal state, FIG. 1(*a*), the beams on each ground plane 20 are actuated (solid lines) with electrostatic force applied through SiCr bias lines, while the shunt beam 35 is in the non-actuated state (dashed lines). In this normal state the signal travels directly from the input 40 to the output 45. In the slow-wave state, FIG. 1(*b*), the beams on the ground plane 20 are in the non-actuated state while the shunt beam 35 is actuated to contact the center conductor 15. The signal thus travels the longer path through the slot 50 in the ground plane 20, thereby increasing the time delay. FIG. 2 provides a three-dimensional view of the slow-wave device in accordance with the present invention. The same identifiers used to identify the elements in FIG. 1(*a*) and FIG. 1(*b*) are used to identify the same elements as shown in the view of the device in FIG. 2. Additionally, the SiCr bias lines 55 to apply the electrostatic force to actuate the beams are shown in FIG. 2. The physical characteristics of a beam in an exemplary embodiment are given in Table 1 of FIG. 8. These physical characteristics include the width 120, length 125 and actuation voltage 130 for the shunt beam and the width 135, length 140 and actuation voltage 145 for the ground plane. Various alternate dimensions are within the scope of the present invention.

Figure 14:
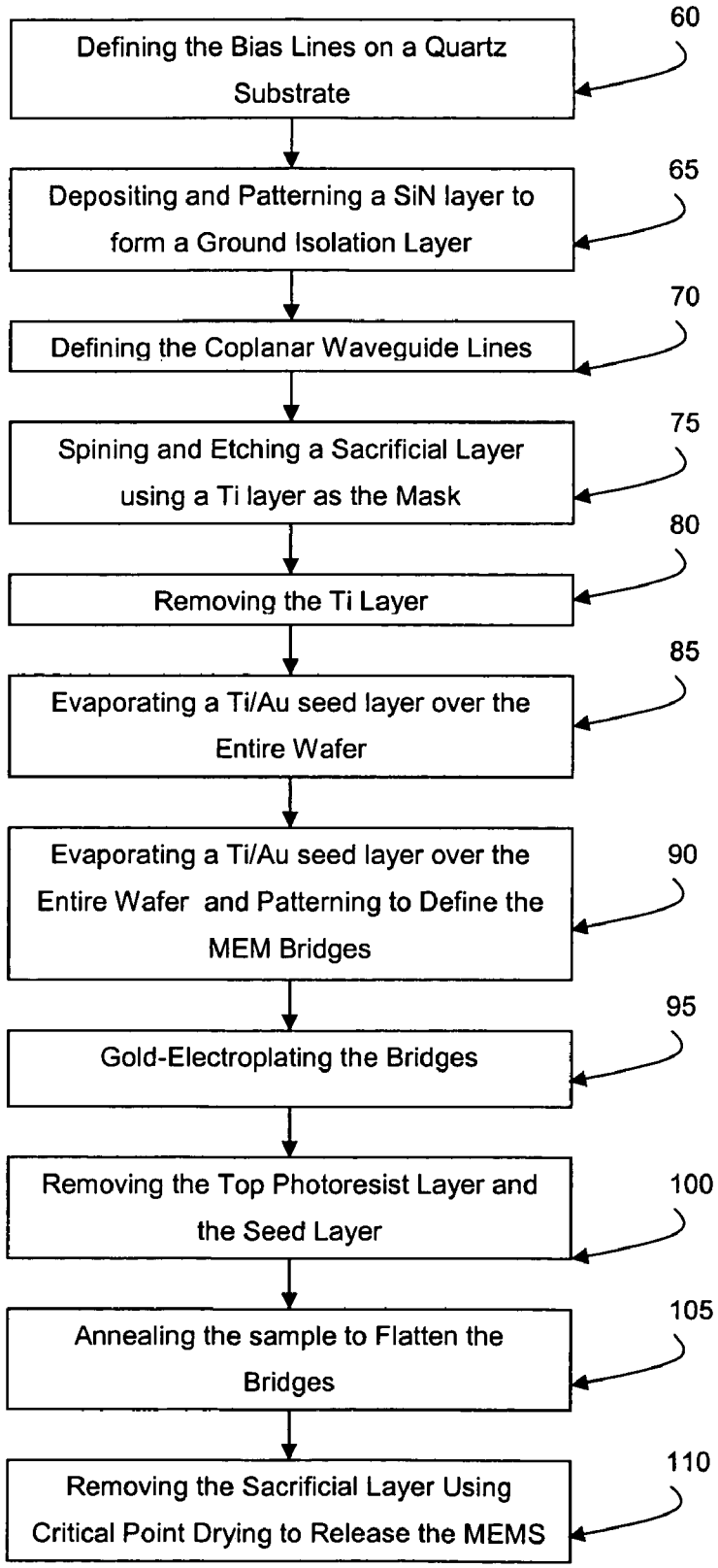
FIG. 14 is an illustrative flow diagram of a method of manufacturing of the slow-wave device in accordance with the present invention.

As shown with reference to the flow diagram of FIG. 14, in an exemplary embodiment, the phase shifters were fabricated on a 500 μm thick quartz substrate ($\epsilon_r$=3.78, tan δ=0.0004). In an exemplary embodiment of the method of manufacturing of the MEM slow-wave device, the SiCr bias lines are defined first using the liftoff technique by evaporating a 1000 Å layer of SiCr using E-beam evaporation 60. The measured line resistivity is approximately 2000 Ω/sq. Next a 4000 Å RF magnetron sputtered $Si_xN_y$ layer is deposited and patterned to form the ground isolation layer 65. The terminology $Si_xN_y$ is commonly used in the art to identify a silicon nitride film having an unknown stoichiometry. The x and v subscripts represent the quantitative relationship between the silicon and the nitrogen constituents in the chemical substance. Because the deposition process and parameters effect the stoichiometry of the resulting film, it is common in the art to use the term "$Si_xN_y$" to identity a layer of unknown stoichiometry. This layer is located where the SiCr bias lines enter the ground conductor. Next the CPW lines are defined by evaporating a Cr/Ag/Cr/Au to a thickness of 150/8000/150/1500 Å using liftoff technique 70. Next the sacrificial layer (MICROCHEM PMMA), is spin coated and etched in a reactive ion etcher (RIE) using a 1500 Å Ti layer as the mask 75. The PMMA layer thickness can be varied from 1.5-2 μm by varying the rotational speed of the spinner from 2500-1500 rpm. In a particular embodiment, the thickness of PMMA is optimized to provide a height of 1.8-2 μm. Next, the Ti layer is removed 80 and a 100/2000 Å Ti/Au seed layer is evaporated over the entire wafer and patterned with photoresist to define the width and the spacing of the MEM bridges 85. The bridges are then gold-electroplated to a thickness of 1 μm 90, followed by removal of the top photoresist layer and seed layer 95. The sample is then annealed at 105° and 120° to flatten the bridges 100 before removing the sacrificial PMMA layer. The sacrificial PMMA layer is removed 105 and critical point drying is used to release the MEMS structures 110. The fabrication steps outlined above are not intended to be limiting and other fabrication methods and processes are within the scope of the present invention.

Measurements of the slow-wave device were performed from 1-50 GHz using a Wiltron 360B vector network analyzer and 150 μm pitch microwave probes available from GGB Industries. A Thru-Reflect-Line (TRL) calibration was performed using calibration standards fabricated on the wafer. A high voltage bias tee was used to supply voltage through the RF probe to avoid damaging the VNA test ports. Typical actuation voltages are shown in Table 1 of FIG. 8. These physical characteristics include the width 120, length 125 and actuation voltage 130 for the shunt beam and the width 135, length 140 and actuation voltage 145 for the ground plane.

Figure 3:
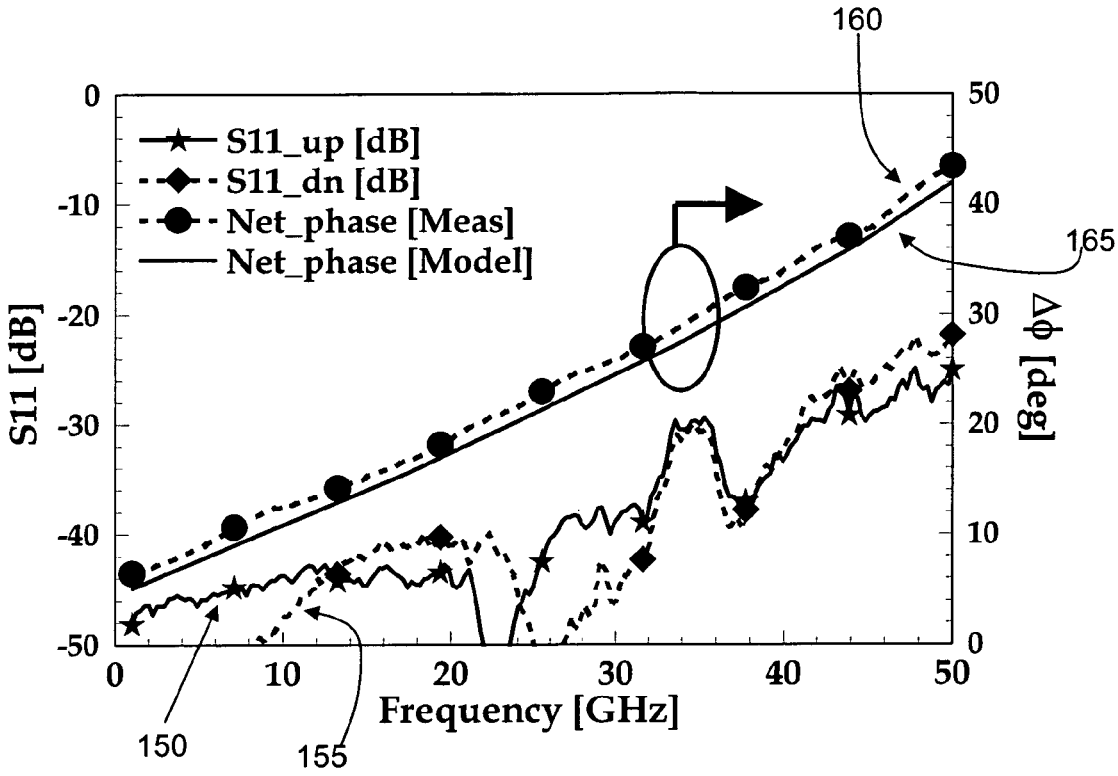
FIG. 3 is an illustrative view of the measured differential phase shift and S11 for the unit-cell in FIG. 1. The return loss (RL) is equal to the negative of S11 in dB. The solid line for $\Delta\phi$ curve represents EM simulation data and the dashed lines represent measured data.

FIG. 3 shows the measured Δϕ 160, the modeled Δϕ 165 and S11 for both the up-state 150 and the down-state 155 of the slow-wave unit-cell. It is seen that Δϕ is approximately 41° at 50 GHz 160 and S11 is below −22 dB from 1-50 GHz for both the up-state 150 and the down-state 155. The worst-case S21 is −0.17 dB for both states.

The measured unit-cell data was fitted to an ideal transmission line model in a circuit simulator to extract the effective characteristic impedance and effective length in each state. The effective characteristic impedance is approximately 52.1Ω for the normal state and 50.9Ω for the slow-wave state. Using the same approach but with results from a full-wave EM simulation using ADS Momentum™ yielded 51.9Ω (normal) and 50.3Ω (slow-wave). Assuming an effective relative dielectric constant of 2.34, the effective length in the normal state is 600 μm and in the slow-wave state it is approximately 1078 μm, resulting in a slowing factor of 1.8.

Figure 4:
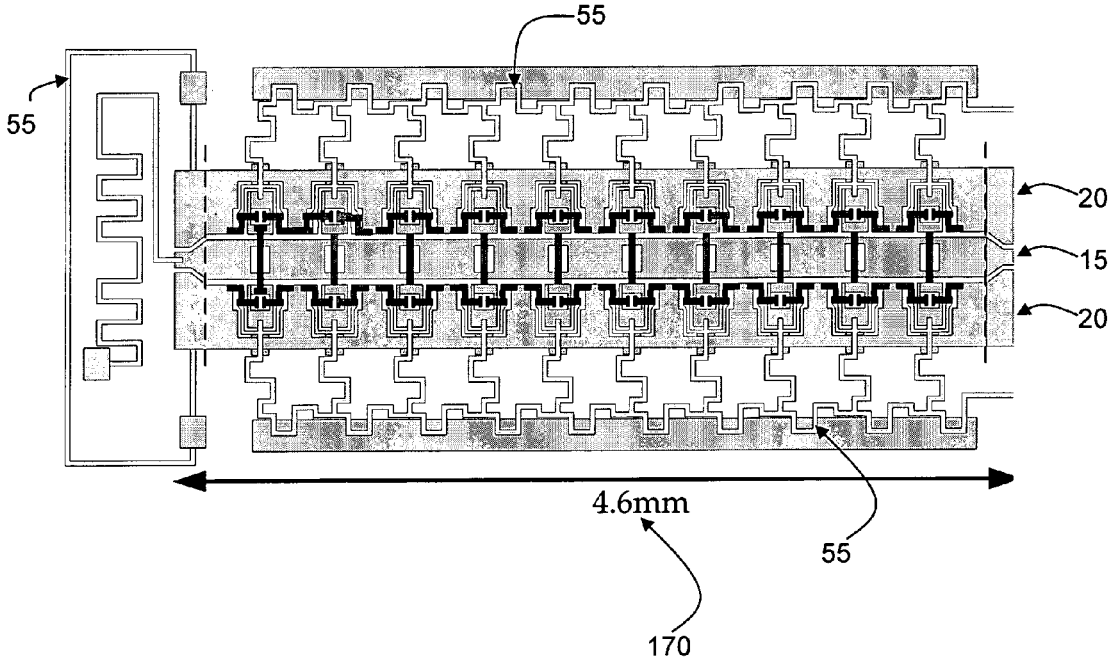
FIG. 4 is an illustrative view of a schematic of the phase shifter in accordance with the present invention. The phase shifter has 10 cascaded slow-wave unit-cells.

The schematic of the phase shifter with ten cascaded slow-wave sections is shown in FIG. 4. For a 1-bit version, the ground plane 20 or shunt beams 35 in all sections are actuated to contact the center conductor 15 simultaneously.

However, given the SiCr bias line configuration 55, it is possible to provide independent bias for a multi-bit operation. In the particular embodiment shown in FIG. 4 the phase shifter device is 4.6 mm in length.

Figure 5:
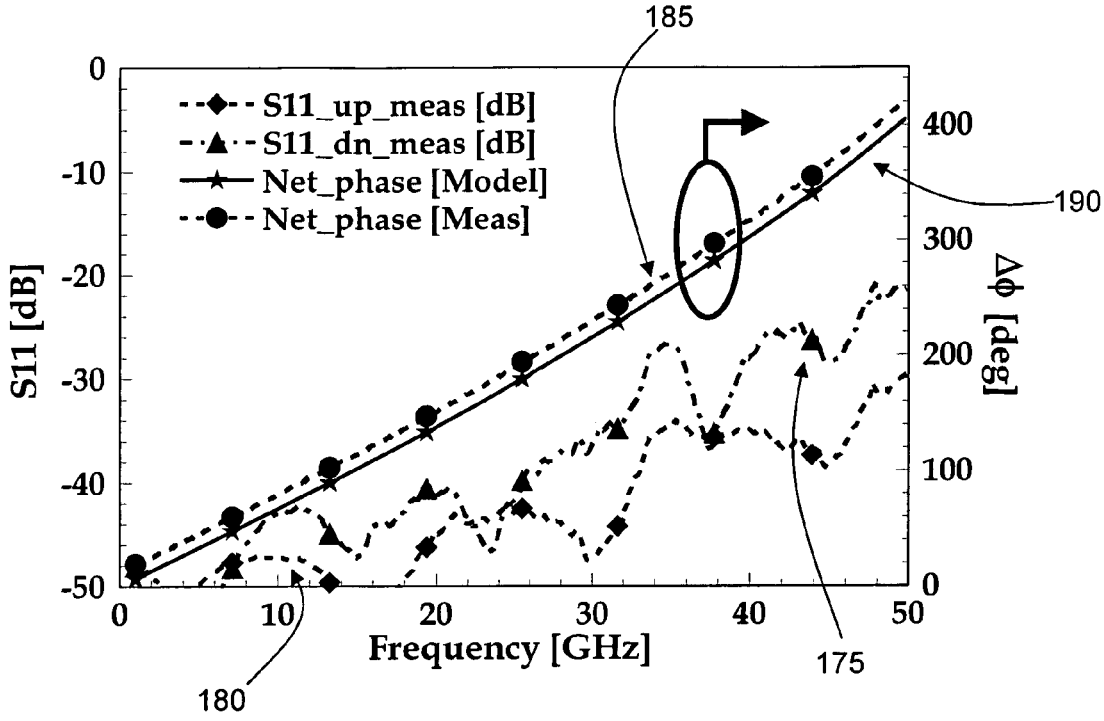
FIG. 5 is an illustrative view of the measured S11 and differential phase shift of the 10-section slow-wave phase shifter in accordance with the present invention. The solid line for $\Delta\phi$ curve represents EM simulation data and the dashed lines represent measured data. The return loss (RL) is equal to the negative of S11 in dB.

FIG. 5 shows the measured SI for the phase shifter in both states, the up-state 180 and the down-state 185, and a comparison of the differential phase shift Δϕ between measured 190 and simulated 195 results for the ten cascaded slow-wave phase shifter shown in FIG. 4. (The simulated results were obtained by cascading full-wave analysis data for the unit-cells in the circuit simulator.) The measured S11 is below −23 dB for both states from 1-50 GHz. Furthermore, the measured 190 and simulated 195 differential phase shift is within 5%, with a measured value of 420° at 50 GHz. The discrepancy in the predicted phase shift can be attributed to the slight increase in the effective impedance of the fabricated circuit, which is approximately 53.55Ω/50.38Ω versus the design values of 52.1Ω/50.9Ω.

Figure 6:
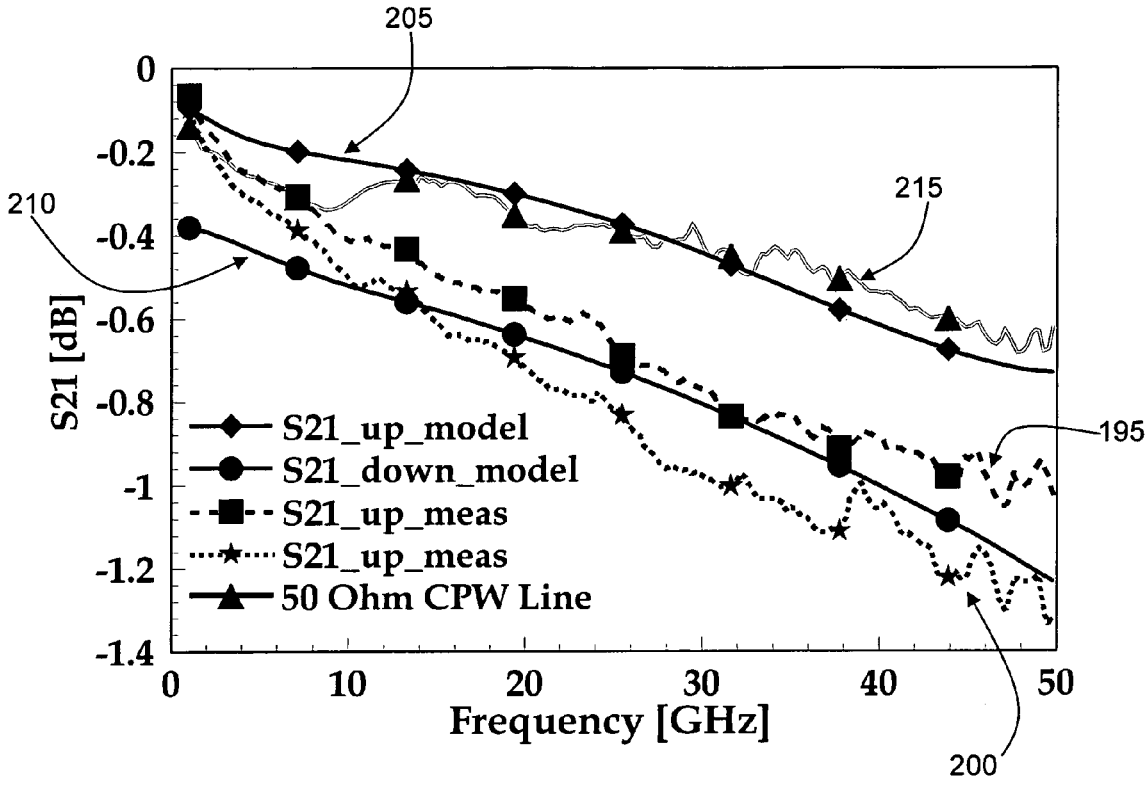
FIG. 6 is an illustrative view of the measured S21 (insertion gain) for both states of the 10-section phase shifter in accordance with the present invention. Solid lines represent EM simulation data and dashed lines represent measured data.

FIG. 6 shows a comparison between the measured insertion loss S21 in both the up-state 195 and the down-state 200 and EM simulation results in both the up-state 205 and the down-state 210 for the phase shifter. The measured insertion loss S21 in the normal state is −0.9 dB at 50 GHz, which is higher than the simulated result by 0.3 dB. The graph also shows the measured S21 for a 50Ω CPW line that is 4.6 mm long 215. It is seen from FIG. 6 that the measured S21 for the slow wave phase shifter in both the states is dominated by transmission line loss for frequency <10 GHz. At higher frequencies, the increase in loss may be due to leakage in the bias circuitry and/or conductor roughness at the edges of the transmission line, which is difficult to account for in the EM simulation. The insertion loss can be improved by creating an air-bridge where the SiCr bias lines enter the ground plane (thereby avoiding the nitride ground isolation layer) and/or by plating the CPW lines.

In an alternate embodiment of the present invention, a MEM capacitor was cascaded with the unit-cell. This design is similar to a DMTL phase shifter with a uniform length of transmission line being replaced with the slow-wave unit-cell. The MEM capacitor is actuated only when the unit-cell is in the slow-wave state. The capacitance ratio is approximately 3.7 ($C_{unloaded}$=30 fF; $C_{loaded}$=8 fF) and chosen such that S11 remains less than −20 dB. The phase shifter illustrate in the figure is operated in a 1-bit version although a multi-bit version is possible by addressing the tuning elements individually and is within the scope of the present invention.

Figure 7:
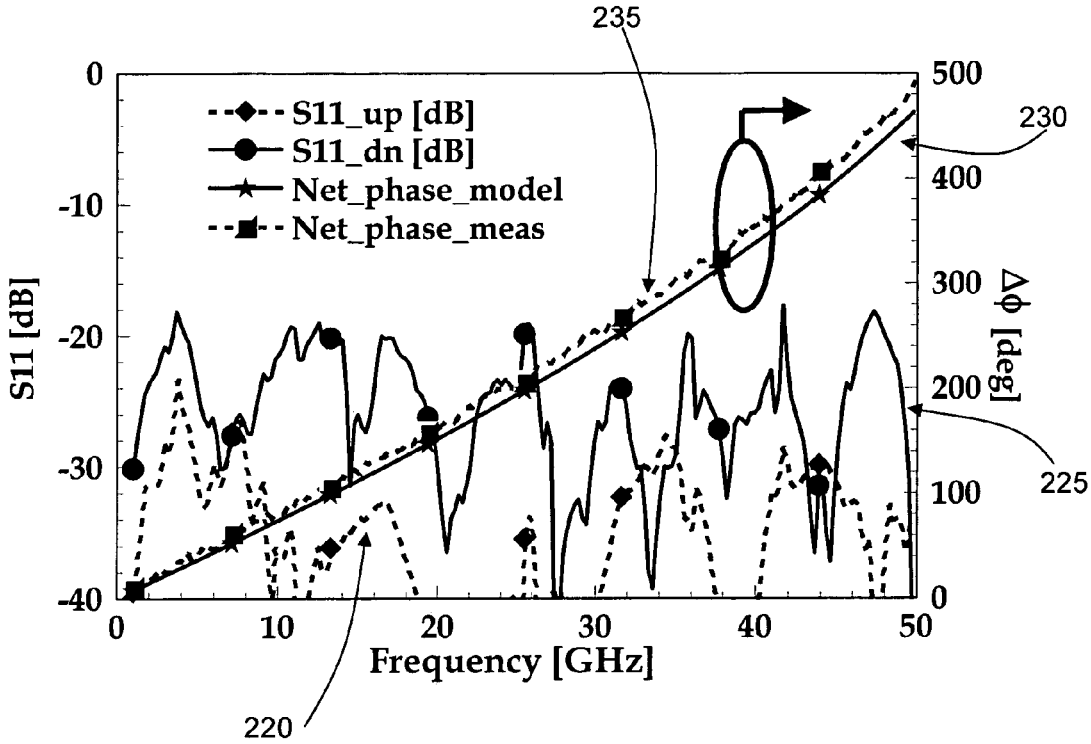
FIG. 7 is an illustrative view of the comparison of S11 and differential phase shift for both the states in accordance with the present invention. Solid lines represent EM simulation data and dashed lines represent measured data.

FIG. 7 shows the measured S11 for the phase shifter in both the up-state 220 and the down state 225 and a comparison of the measured 235 and simulated 230 differential phase shift Δϕ. The measured S11 is below −19 dB and the worst case insertion loss is approximately −1.9 dB from 1-50 GHz. In comparison to the slow-wave only design, the differential phase shift Δϕ increases by a factor 17.2% at 50 GHz to 490°, however there is less Δϕ per mm. The Δϕ per mm can be improved by eliminating the length of CPW line on either side of the MEM capacitor (250 μm per unit-cell). Furthermore, the differential phase shift Δϕ is also easily adjusted by changing the capacitance ratio of the MEM capacitor, especially when lower return loss performance can be tolerated.

In an additional embodiment, a 2-bit version of the capacitively loaded phase shifter was designed to provide Δϕ of 45° and 90° at 25 GHz. Experimental results for the 2-bit version resulted in Δϕ of 49.3° and 81.5° with S11<−21 dB through 50 GHz and the worst case insertion loss <1.15 dB.

In accordance with the present invention, a true-time-delay CPW phase shifter operating from 1-50 GHz is presented that utilizes slow-wave MEM sections. The measured S11 for a slow-wave unit-cell is below −20 dB with a differential phase shift of 34° at 40 GHz. A phase shifter comprised of 10 slow-wave unit-cells is shown to have S11 less than −20 dB with a phase shift of 317° at 40 GHz. The predicted and measured results for the phase shift agree to within 5%. In one embodiment of the invention, the goal was to keep S11 below −20 dB. However, if the constraint on S11 is relaxed to −10 dB the simulated phase shift is approximately 450° at 40 GHz. The unit-cells in the phase shifter can be addressed individually for a multi-bit operation and can possibly result in 10 phase states.

Figure 9:
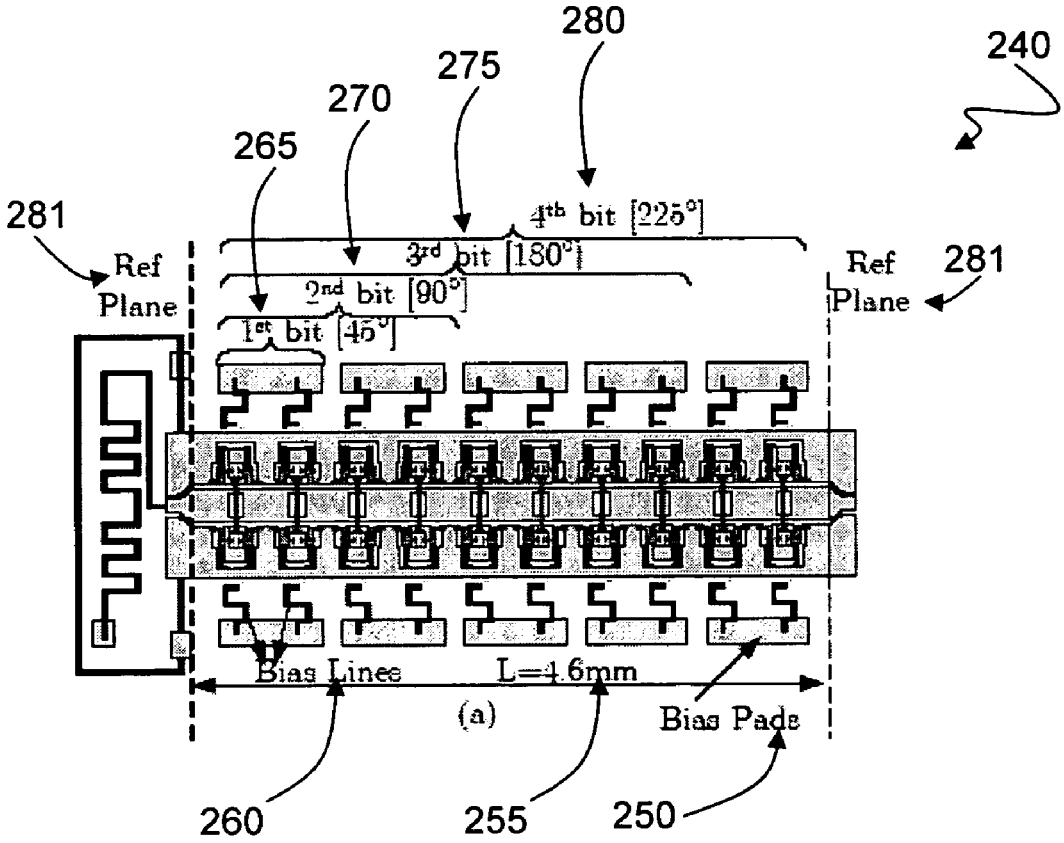
FIG. 9 is an illustrative view of a 4-bit MEM slow-wave phase shifter in accordance with the present invention.
Figure 10:
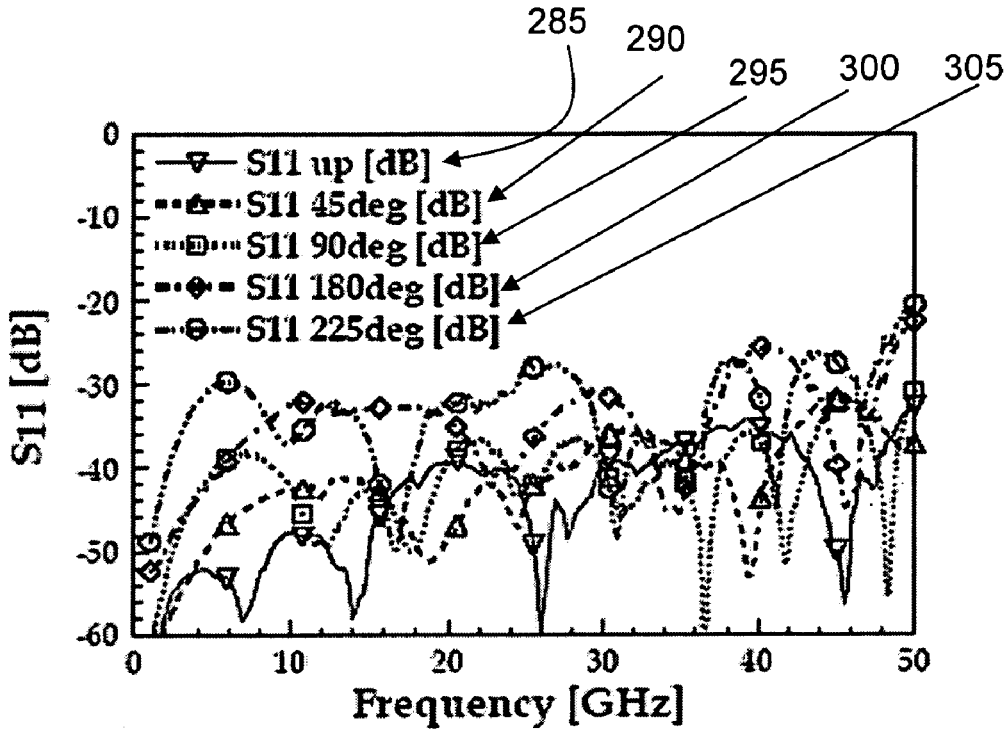
FIG. 10 is an illustrative view of the S11 of the 4-bit slow-wave MEM phase shifter in the various states as identified, in accordance with the present invention.
Figure 11:
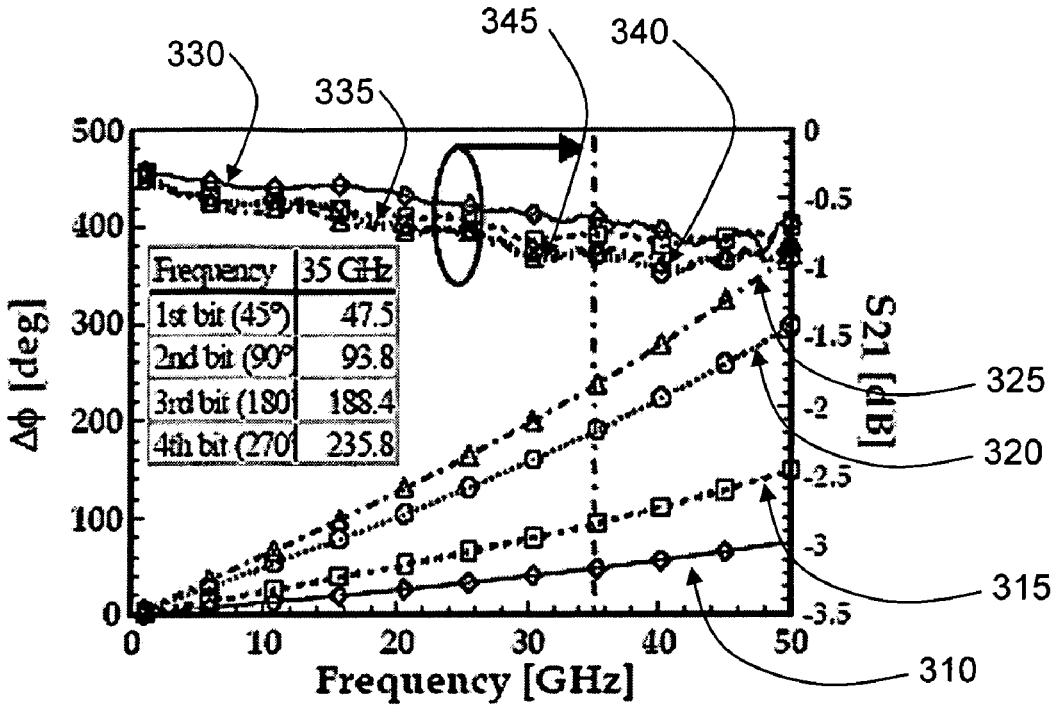
FIG. 11 is an illustrative view of the comparison of S11 and the differential phase shift for the states of the 4-bit slow-wave MEM phase shifter in accordance with the present invention.

In an additional embodiment, an electronically tunable Thru-Reflect-Line (TRL) calibration set that utilizes a 4-bit true time delay MEMS phase shift topology in accordance with the present invention is provided. With reference to FIG. 9, a 4-bit phase shifter 240 is illustrated consisting of 10 cascaded slow-wave unit cells and is designed to provide small variations in the impedance around 50Ω on a 500 μm thick quartz substrate. The unit-cells in the phase shifter can be addressed individually for a multi-bit operation to establish $1^{st}$ bit, $2^{nd}$ bit, $3^{rd}$ bit and $4^{th}$ bit as shown. In FIG. 9, (a) represents the length of the 4-bit phase shifter in accordance with the present invention, which in this exemplary embodiment is shown to be L=4.6 mm 255. The states of the phase shifter in accordance with this embodiment provide Δϕ of 45° 265, 90° 270, 180° 275 and 225° 280 at 35 GHz. Actuation of the unit cells is controlled by the bias lines 260 from the bias pads 250. In an exemplary embodiment, measurements of the electronically tunable TRL were performed from 1-50 GHz relative to the reference plane 281 of FIG. 9. A multi-line TRL calibration was performed using conventional calibration standards fabricated on the wafer. FIG. 10 illustrates the measured S11 for the phase shifter in all the states, S11 up-state 285, S11 at 45° 290, S11 at 90° 295, S11 at 180° 300 and S11 at 225° 305, while FIG. 11 illustrated the measured Δϕ for the $1^{st}$ bit 310, $2^{nd}$ bit 315, $3^{rd}$ bit 320 and $4^{th}$ bit 325 and worst case S21 (dB) for the $1^{st}$ bit 330, $2^{nd}$ bit 335, $3^{rd}$ bit 340 and $4^{th}$ bit 345 of the 4-bit phase shifter. As such, a true-time-delay 4-bit CPW phase shifter operating from 1-50 GHz is within the scope of the present invention that utilizes slow-wave MEMS sections. The experimental results for this embodiment demonstrate S11 less than −21 dB through 50 GHz with Δϕ/dB of approximately 317°/dB at 50 GHz. Accordingly, an electronically tunable calibration is made possible by realizing all the line standards using the multi-bit phase shifter in a multi-line TRL. The Tunable TRL device and method in accordance with the present invention provide for an efficient usage of wafer area while retaining the accuracy associated with the TRL technique, and reduces the number of probe placements from five to two, with potentially no change in probe separation distance.

Figure 12:
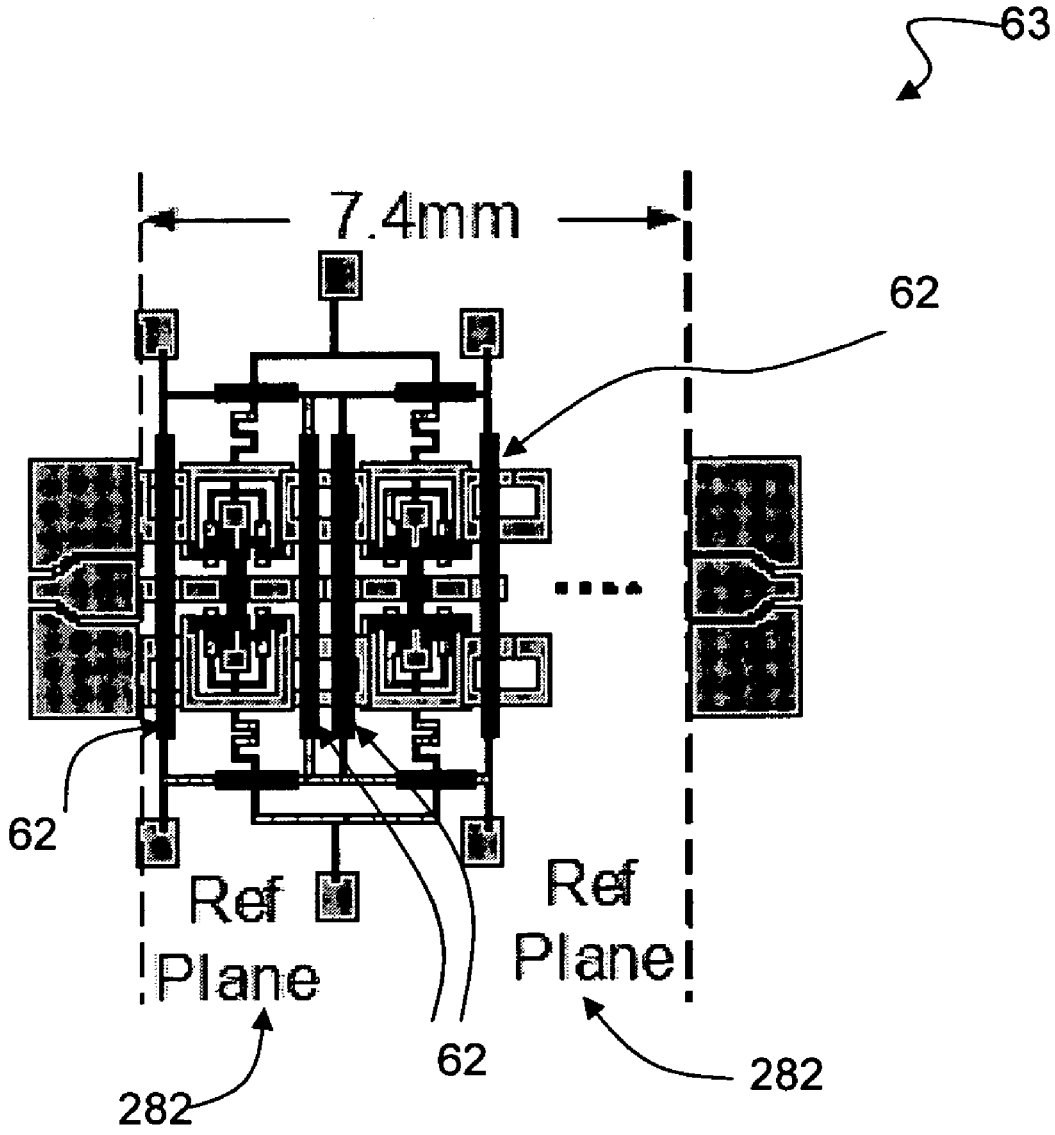
FIG. 12 is an illustrative view of a 1-bit phase shifter employing maximum phase shift by actuating the MAM capacitors in the delay state of the slow-wave sections.

In yet another embodiment, a reconfiguration MEMS-based transmission line in which there is independent control of the propagation delay and the characteristic impedance is provided. In accordance with this embodiment, separate control of inductive and capacitive MEMS slow-wave devices in accordance with the present invention are used either to maintain a constant LC product (constant $Z_0$) or a constant L/C ratio (constant β), while changing the ratio or product, respectively. With reference to FIG. 12, a device in accordance with this embodiment is shown in which a slow-wave device with metal-air-metal (MAM) capacitors 60 at the input and the output of the slow-wave device are provided. In FIG, 12, the length of the phase shifter in accordance this exemplary embodiment is shown to be 7.4 mm. With this embodiment, $Z_0$-tuning is realized by operating the slow-wave section in conjunction with the MAM capacitors: the low-$Z_0$ mode corresponds to the normal state with actuated MAM capacitors, which the high-$Z_0$ is realized in the delay state with non-actuated MAM capacitors. Maintaining a constant propagation constant (β) with $Z_0$-tuning is achieved by proper selection of the capacitance ratio ($C_r=C_{max}/C_{min}$). Specifically, Δφ due to the MAM capacitor ($\Delta\phi_{MAM}$), separated by a 270 μm long uniform CPW line, offsets the Δφ due to the slow-wave section ($\Delta\phi_{slow\text{-}wave}$). For a given spacing (s) between capacitors and the total length (L), equation (2) is used to calculate $C_r$.

$$\Delta\phi = (\omega\sqrt{L_t C_t}) \times \left[\sqrt{1+\frac{C_b}{sC_t}} - \sqrt{1+\frac{C_r C_b}{sC_t}}\right] L \text{ rad} \tag{2}$$

Where, Lt and Ct are the per-unit-length inductance and capacitance in the normal state. Using (2), Cr=2.6 for Δφ=46°, s=270 μm, Cb=24 fF, Lt=0.33 nH/mm, Ct=0.07 pF/mm, and L=740 μm.

The different Zo levels are determined by considering the transmission line section between MAM capacitors (the slow-wave section) as a uniform CPW line. The effective impedance (Zeff) is then calculated using (3). For the distributed parameters used herein, Zeff can be set to approximately 38Ω or 50Ω; parasitic loading of the shunt beam and other discontinuity effects increase the actual levels to 40/52Ω values stated above.

$$Z_{eff} = \sqrt{\frac{L_t}{1+\frac{C_b}{sC_t}}} \tag{3}$$

Figure 13:
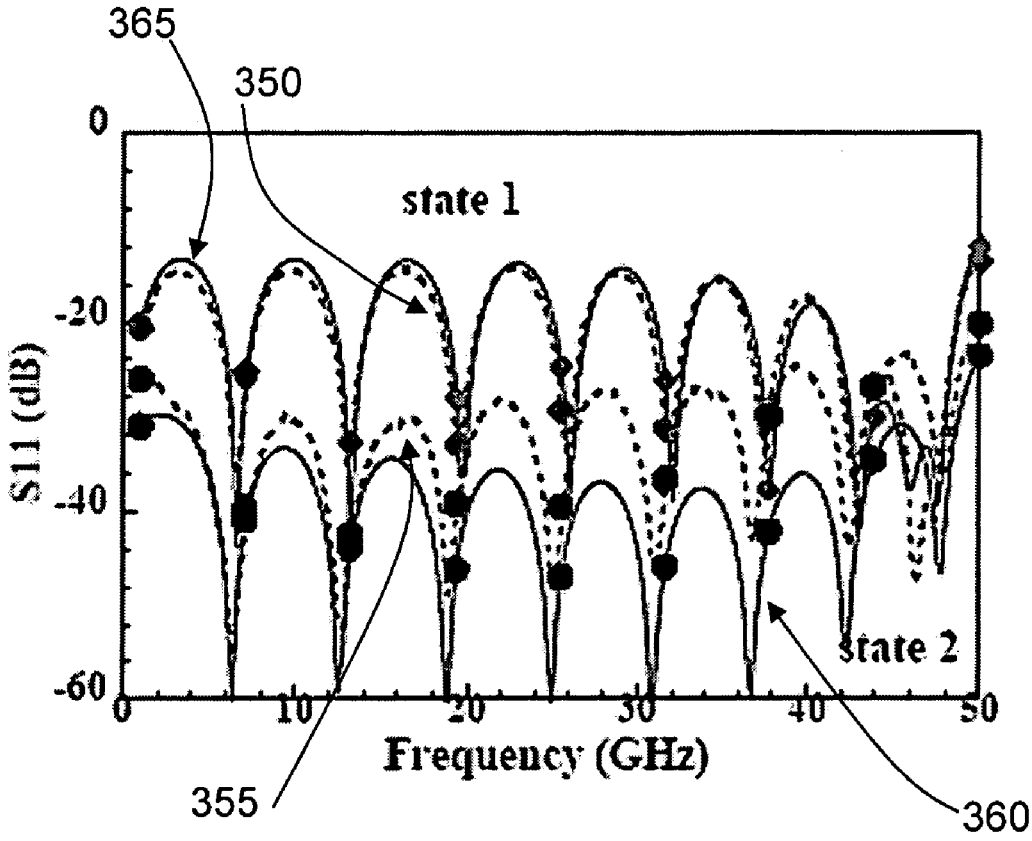
FIG. 13 is an illustrative of the comparison of measured (dashed) and simulated (solid) S11 (dB) of a 7.4 mm-long tunable Zo-line with constant propagation constant in both states.

With reference to FIG. 12, a 1-bit phase shifter with maximum phase shift by actuating the MAM capacitors in the delay state of the slow-wave sections is illustrated. FIG. 13 illustrates the measured S11 for the phase shifter in accordance with the embodiment illustrated in FIG. 12, relative to the reference plane 282, in both states, up-state S11 350 and down-state S11 355, and a comparison of the differential phase shift between the measured 350, 355 and simulated results 360, 365.

Accordingly, a method and apparatus is provided that has application in many areas. Including, but not limited to, dynamically-controlled planar transmission line standards for electronic-calibration of vector network analyzers. In particular, standards for use with the Thru-Reflect-Line (TRL) calibration method and other calibration methods that include the use of two or more lines of varying electrical length are provided. Additional uses include, tunable distributed filter topologies which incorporate transmission line "stubs" of varying electrical length that are spaced by varying electrical lengths, and other tunable components that operate on the distributed transmission line principle, including but not limited to couplers, impedance matching networks, balanced-to-unbalanced transformers (BALUNS), and various transitions between different planar transmission line topologies, such as coplanar waveguide to slotline transitions.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A microelectromechanical slow-wave phase shifter device, the device comprising:

at least one slow-wave phase shifter unit cell, each of the at least one slow-wave phase shifter unit cells further comprising, a center conductive element, two ground plane elements laterally located proximal to the center conductive element, the two ground plane elements each having a slot disposed therein, with an actuatable ground shorting beam and an actuatable shunt beam configured to control access to the slot disposed in each of the two ground plane elements.

2. The device of claim 1, wherein the actuatable ground shorting beam further comprises:

a first one of two actuatable ground shorting beams having electrical connectivity to a first one of the two laterally located ground plane elements, and a second one of two actuatable ground shorting beams having electrical connectivity to a second one of the two laterally located ground plane elements; and a ground shorting beam bias line to control actuation of the ground shorting beams.

3. The slow-wave device of claim 2, wherein the ground shorting beam bias line of each one of the at least on slow-wave phase shifter unit cells are electrically connected such that each ground shorting beam of each of the slow-wave phase shifter unit cells are actuated substantially simultaneously.

4. The slow-wave device of claim 2, wherein the ground shorting beam bias lines of each one of the plurality of slow-wave phase shifter unit cells are electrically isolated such that each ground shorting beam of each of the slow-wave phase shifter unit cells are actuated substantially independently.

5. The slow-wave device of claim 2, wherein the ground shorting beam bias line supplies an electrostatic force to actuate the ground shorting beam.

6. The slow-wave device of claim 1, wherein the device is integrated along the length of a planar transmission line.

7. The slow-wave device of claim 1, wherein the at least one slow-wave phase shifter unit cell further comprises:

a planar transmission line having a transmission line center conductor and two laterally located transmission line ground planes on either side of the transmission line center conductor; and wherein the center conductive element of the at least one slow-wave phase shifter unit cell is electrically connected to the transmission line center conductor and one of each of the two ground plane elements of the at least one slow-wave phase shifter unit cell are electrically connected to one of each of the two laterally located transmission line ground planes of the transmission line.

8. The device of claim 1, wherein the actuatable shunt beam is suspended over the center conductive element and electrically connecting the two ground plane elements and further comprises a shunt beam bias line to control actuation of the shunt beam.

9. The slow-wave device of claim 8, wherein the shunt beam bias line of each one of the at least one slow-wave phase shifter unit cells are electrically connected such that each shunt beam of each of the slow-wave phase shifter unit cells are actuated substantially simultaneously.

10. The slow-wave device of claim 8, wherein the shunt beam bias line of each one of the at least one slow-wave phase shifter unit cells are electrically isolated such that each shunt beam of each of the slow-wave phase shifter unit cells are actuated substantially independently.

11. The slow-wave device of claim 8, wherein the shunt beam bias line supplies an electrostatic force to actuate the shunt beam.

12. The slow-wave device of claim 1, further comprising at least one actuatable microelectromechanical capacitor.

13. The slow-wave device of claim 1, wherein each of the at least one slow-wave phase shifter unit cells further comprises an actuatable microelectromechanical capacitor, the actuatable capacitor positioned at an input to and an output from each of the at least one slow-wave phase-shifter unit cells.

14. A slow-wave unit microelectromechanical phase shifter device, the device comprising:

means for routing a transmission signal along the length of a coplanar waveguide transmission line; and means for shunting the propagation of the transmission signal along the length of the transmission line and rerouting the transmission signal through a conductive slot located within a ground plane of the transmission line.

15. The slow-wave device of claim 14, further comprising means for integrating the slow-wave device along the length of the coplanar waveguide transmission line.

16. The slow-wave device of claim 14, further comprising means for integrating at least one actuatable microelectromechanical capacitor with a path located in the ground plane of the transmission line.

17. A method of varying the propagation time of a transmission signal along the length of a transmission line, the method comprising the steps of:

establishing at least one conductive slot along the length of a ground plane of a transmission line, the transmission line further comprising a center conductive element and two ground plane elements;

directing the flow of the transmission signal through the at least one conductive slot formed in the two ground plane elements of the transmission line, thereby increasing the propagation time of the signal along the length of the transmission line; and shunting the flow of the transmission signal past the at least one conductive slot formed in the two ground plane elements, thereby decreasing the propagation time of the signal along the length of the transmission line.

18. The slow-wave device of claim 17, further comprising the steps of:

providing a planar transmission line having a center conductor and two laterally located ground planes on either side of the center conductor;

electrically connecting the center conductive element to the center conductor of the planar transmission line;

electrically connecting a corresponding one of the two ground plane elements to each of the two laterally located ground plane elements of the transmission line.

19. The method of claim 17, wherein the step of shunting the flow of the transmission signal past the conductive slot further comprises:

providing a first one of two actuatable ground shorting beams having electrical connectivity to a first one of the two ground plane elements, and a second one of two actuatable ground shorting beams having electrical connectivity to a second one of the two ground plane elements; and providing a ground shorting beam bias line to control actuation of the first one of two actuatable ground shorting beams and the second one of two actuatable ground shorting beams.

20. The slow-wave device of claim 19, further comprising the step of supplying an electrostatic force through the ground shorting beam bias line to actuate the first one of two actuatable ground shorting beams and the second one of two actuatable ground shorting beams.

21. The device of claim 17, wherein the step of directing the flow of the transmission signal through the at least one conductive slot formed in the two ground plane elements further comprises:

providing an actuatable shunt beam suspended over the center conductive element and electrically connecting the two ground plane elements; and providing a shunt beam bias line to control actuation of the shunt beam.

22. The slow-wave device of claim 21, further comprising the step of supplying an electrostatic force through the shunt beam bias line to actuate the shunt beam.

* * * * *